US005288084A

United States Patent [19]

Miller

[11] Patent Number: 5,288,084

[45] Date of Patent: Feb. 22, 1994

[54] OBJECT CONTACT INTERPRETATION GAME

[76] Inventor: Kenneth A. Miller, 102 Jacqueline Ct., Bonaire, Ga. 31005

[21] Appl. No.: 983,039

[22] Filed: Nov. 30, 1992

[51] Int. Cl.[5] ..... A63F 9/00

[52] U.S. Cl. ..... 273/440; 273/459; 434/237

[58] Field of Search ..... 273/459, 440, 450, 460, 273/454, 456; 434/237

[56] References Cited

U.S. PATENT DOCUMENTS 3,390,469 7/1968 Rader ..... 273/440 X 3,458,189 7/1969 Holt ..... 273/459 X 3,484,105 12/1969 Winston ..... 273/440

3,768,176 10/1973 Huddleston ..... 273/459 X

*Primary Examiner*—Paul E. Shapiro

*Attorney, Agent, or Firm*—E. M. Combs

[57] ABSTRACT

A game is arranged to include a plurality of players to include at least, having a judge to effect construction of an object, a visual interpreter to descriptively draw the interpretation of a tactile interpreter that directs the tactile interpreter's hands into an enclosure to describe to the visual interpreter the object positioned within the enclosure.

4 Claims, 3 Drawing Sheets

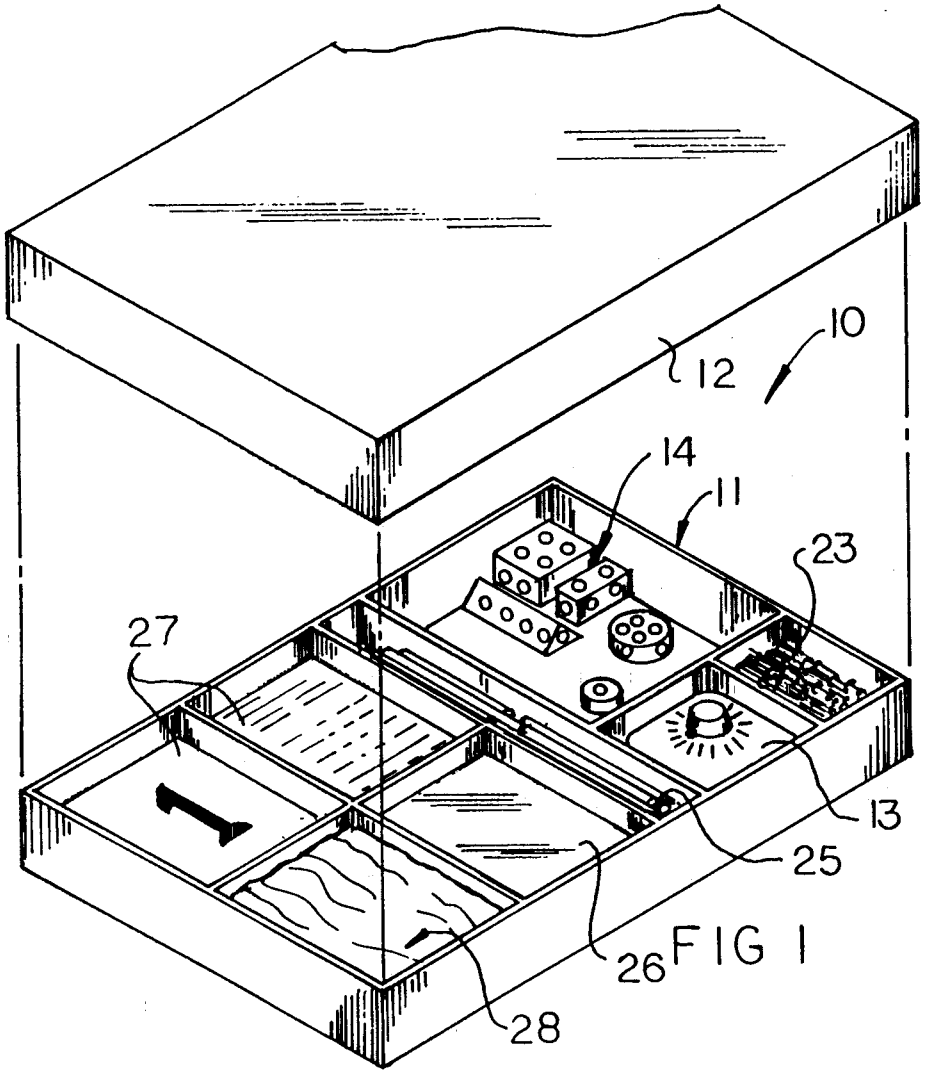
FIG 1
Interpretation Judging Form:
Tactile Interpreter:_____ Visual Interpreter:_____
| | Handicap ____ | | | Handicap ____ | |
|---|---|---|---|---|---|
| | Best | | | | Worse |
| Difficulty | 5 | 4 | 3 | 2 | 1 |
| Accuracy | 5 | 4 | 3 | 2 | 1 |
| Detail | 5 | 4 | 3 | 2 | 1 |
| Creativity | 1.25 | — | 1 | — | .75 |
| Time Remaining | 1.25 | — | — | — | 1 |
Score = (Difficulty + Accuracy + Detail) * Creativity * Time remaining
____=(____+____+____)*____*____
Handicaped score = Score * Handicap
____=____*____
27
FIG 2
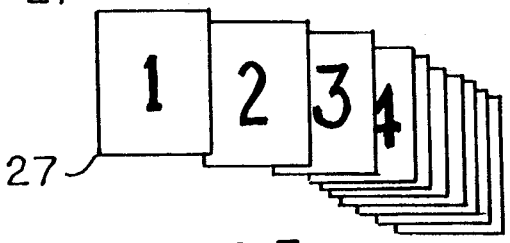
FIG 3

OBJECT CONTACT INTERPRETATION GAME

BACKGROUND OF THE INVENTION

1. Field of the Invention

The field of invention relates to game structure, and more particularly pertains to a new and improved object contact interpretation game wherein the touching of an object within an enclosure without permitting visual observation of the object is interpreted by a third party.

2. Description of the Prior Art

Games and game apparatus of various types are utilized throughout the prior art, such as exemplified in the U.S. Pat. Nos. 5,007,648; 4,746,123; 4,961,584; and 4,274,630.

The instant invention sets forth a game method and apparatus in a manner not set forth by the prior art wherein at least three players are required to permit one of the players to visually contact an object within an enclosure and interpret the thusly contacted object to a visual interpreter. A third party or judge awards points relative to the drawing effected by the visual interpreter relative to the object that is positioned within the enclosure.

SUMMARY OF THE INVENTION

In view of the foregoing disadvantages inherent in the known types of method and game apparatus now present in the prior art, the present invention provides an object contact interpretation game wherein the same directs a plurality of players to effect construction of an object, position an object within an enclosure, direct a further player to interpret the configuration of the object within the enclosure, and further direct such interpretation of the object to an interpreter of the contacting players experience. As such, the general purpose of the present invention, which will be described subsequently in greater detail, is to provide a new and improved object contact interpretation game which has all the advantages of the prior art game apparatus and none of the disadvantages.

To attain this, the present invention provides a game arranged to include a plurality of players to include at least, having a judge to effect construction of an object, a visual interpreter to descriptively draw the interpretation of a tactile interpreter that directs the tactile interpreter's hands into an enclosure to describe to the visual interpreter the object positioned within the enclosure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved object contact interpretation game which has all the advantages of the prior art game apparatus and none of the disadvantages.

It is another object of the present invention to provide a new and improved object contact interpretation game which may be easily and efficiently manufactured and marketed.

It is a further object of the present invention to provide a new and improved object contact interpretation game which is of a durable and reliable construction.

An even further object of the present invention is to provide a new and improved object contact interpretation game which is susceptible of a low cost of manufacture with regard to both materials and labor, and which accordingly is then susceptible of low prices of sale to the consuming public, thereby making such object contact interpretation games economically available to the buying public.

Still yet another object of the present invention is to provide a new and improved object contact interpretation game which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the game within a predetermined enclosure.

FIG. 2 is an orthographic view of a typical score card structure utilized.

FIG. 3 is an isometric illustration of the score cards as positioned within the game container.

DESCRIPTION OF THE PREFERRED EMBODIMENT

Figure 4:
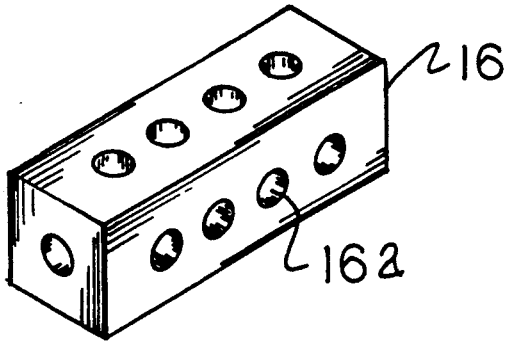
FIGS. 4, 5, 6, 7, 8, 9, 10, and 11 are isometric illustrations of various geometric members for assemblage within the game structure.
Figure 5:
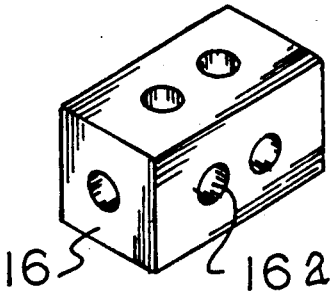
Figure 6:
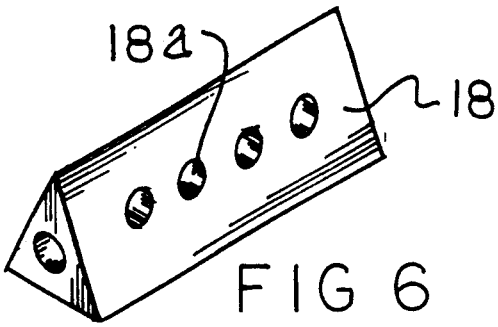
Figure 7:
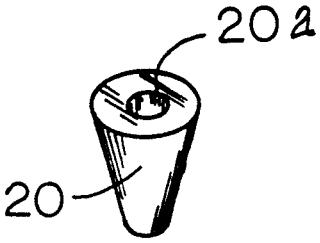
Figure 8:
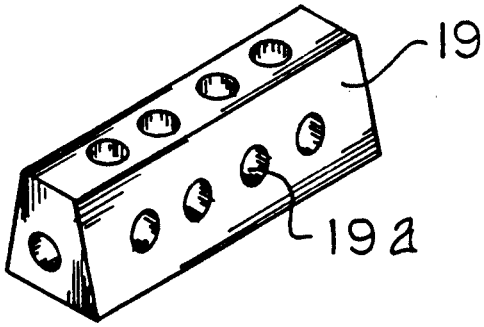
Figure 9:
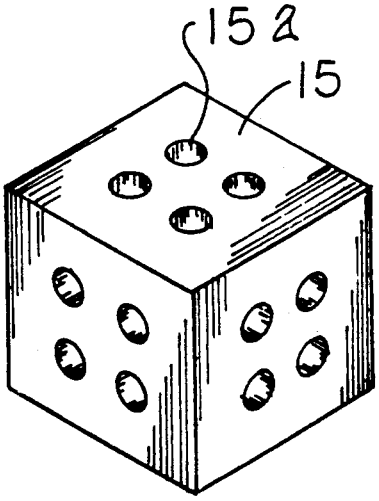
Figure 10:
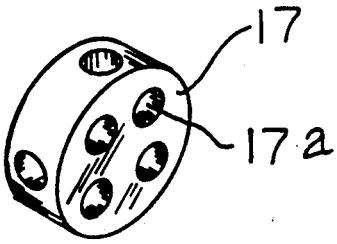
Figure 11:
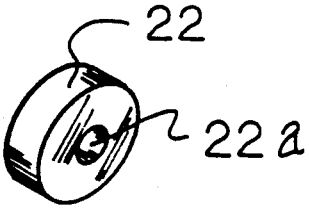
Figure 12:
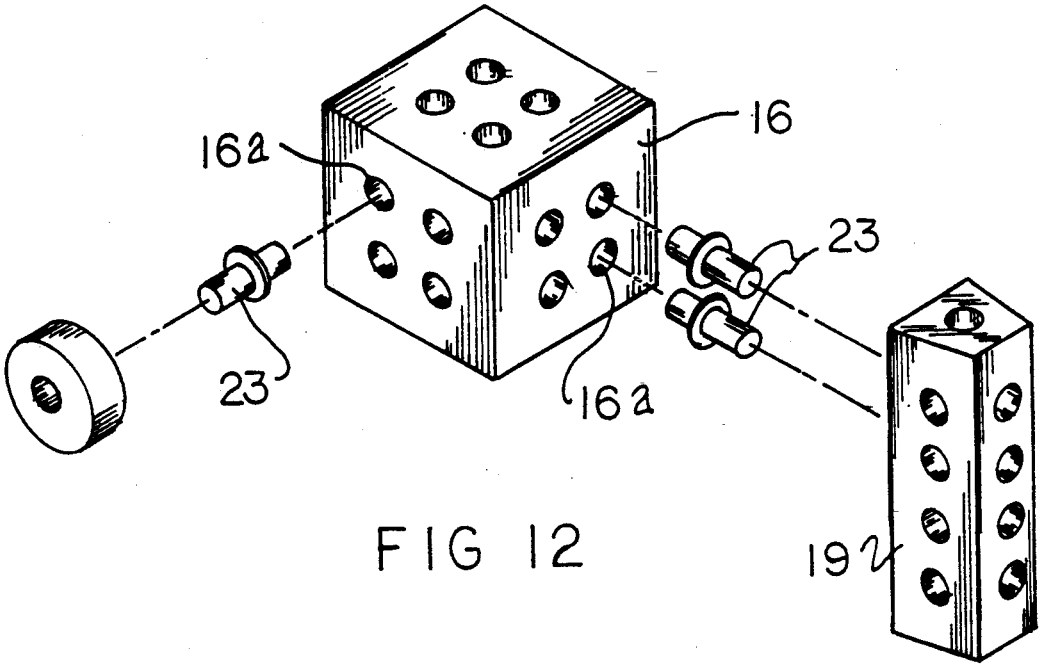
FIG. 12 is an isometric illustration of a plurality of the geometric members arranged for assembly.
Figure 13:
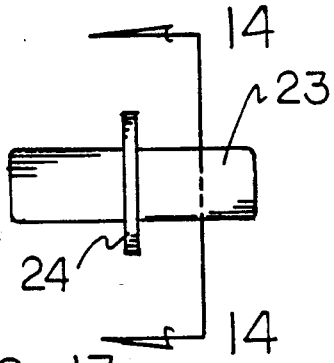
FIG. 13 is an orthographic view of a connecting rod structure.
Figure 14:
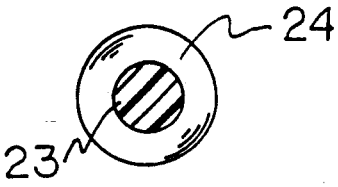
FIG. 14 is an orthographic view, taken along the lines 14—14 of FIG. 13 in the direction indicated by the arrows.
Figure 15:
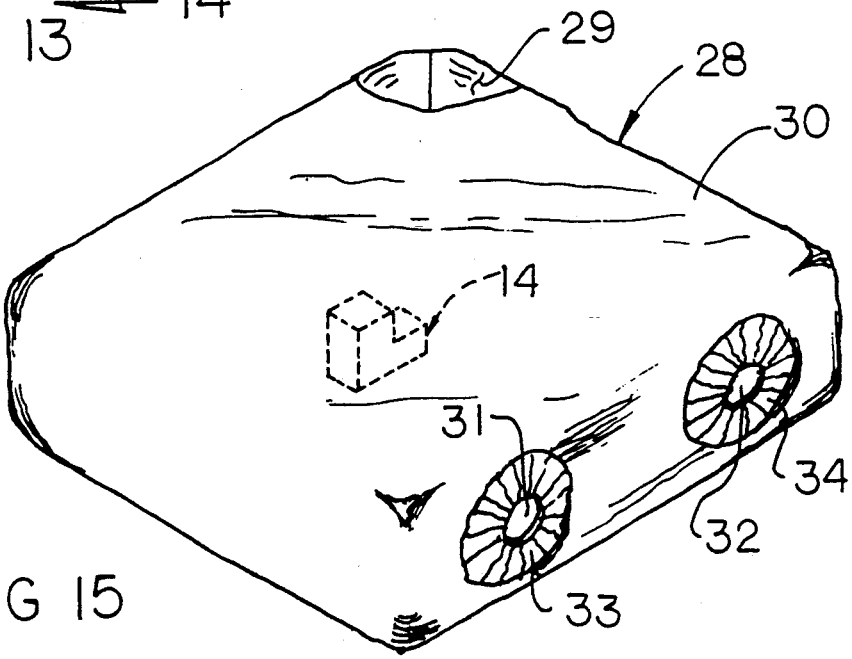
FIG. 15 is an isometric illustration of the enclosure member utilized by the invention.

With reference now to the drawings, and in particular to FIGS. 1 to 15 thereof, a new and improved object contact interpretation game embodying the principles and concepts of the present invention and generally designated by the reference numeral 10 will be described.

More specifically, the object contact interpretation game 10 of the instant invention essentially comprises typically a compartmented container 11 having a container lid 12 removably mounted relative to the container for access to components therewithin. For typical employment by the invention is a timer mechanism 13 arranged to provide for timing of variously determined time sequences for use with the organization. A plurality of geometric members 14 are provided to include an apertured cube 15 having cube bores 15*a*. An apertured parallelepiped 16 includes parallelepiped bores 16*a* (see FIG. 5). The apparatus includes an apertured cylinder 17 having cylinder bores 17*a*, an apertured triangulated component 18 having triangulated component bores 18*a*, a trapezoidal component 19 having trapezoidal component bores 19*a*, a truncated conical component 20 having a truncated conical component bore 20*a* typically directed coaxially of the truncated conical component 20. A disc 22 is provided having a disc axial bore 22*a*. The geometric members 14, as indicated in the FIGS. 4–11, are exemplary but not limited and variously configurations, as well as multiplicity of such components, as indicated in the FIGS. 4–11 may be provided. A plurality of connecting rods 23 are provided within the container 11, having a connector rod flange 24 medially of each connector rod 23 and projecting laterally of each connector rod 23 as the rods 23 individually associate the bores of various apertured geometric members, such as illustrated in the FIGS. 4–11, and as exemplified in FIG. 12 to secure various components together. An assembled configuration of the members 14 is subsequently positioned within a flexible bag enclosure 28 and more specifically within the bag cavity 29. The flexible bag enclosure 28 may be formed of any desirable, flexible material to include polymerics, fabrics, and the like. The enclosure 28 includes a continuous outer wall 30 having a respective first and second bag opening 31 and 32, with the bag openings 31 and 32 including surrounding elastomeric first and second perimeter webs 33 and 34 to secure an individual's wrists when the individual's hands are positioned within the cavity 29 for effecting sensation and permitting description of the assembled geometric components within the enclosure 28. Description of the enclosure 28 is directed to a further player to be described as a visual interpreter. It is desired that a further individual as a "judge" is the individual constructing the geometric component to be positioned within the enclosure 28, with the individual performing the touching and verbal interpretation having an individual's hands within the enclosure 28 described as the "tactile" interpreter. In this manner, at least three players for play of the game are provided. It is understood that a plurality of such players with each player in turn performing a function of a "judge", "tactile" interpreter, and "visual" interpreter be provided. It may also be provided that a fourth player to function as a "timer" be provided should a minimum of four players be desired, with the timer individual providing for sequencing of the time relative to play of the game utilizing the timer mechanisms 13.

Typically, the judge assembles an object employing the geometric members 14 without other players being able to observe the object thusly assembled. The judge will then position the object within the enclosure cavity 29, whereupon subsequently, the tactile interpreter be given one minute for example to contact the object physically and subsequently be provided a further period of time such as five minutes to continue to feel the object and describe the same to the visual interpreter. The visual interpreter will then employ a writing instrument 25 and sketch the thusly described geometric component upon a sketch pad 26 or other available writing instrument. Score cards 27 are provided, whereupon at the end of the descriptive period, the visual interpreter is provided a further time period such as one minute to finish the drawing, at which time the judge upon comparison of the assembled component within the enclosure 28 judges the same utilizing a score card 27 of a type as exemplified but not limited to the illustration of FIG. 2. The score 27, as indicated in FIG. 2, employs arbitrary characteristics of difficulty, accuracy, detail, and creativity relative to the object thusly configured by the visual interpreter as well as providing for, if desired, point awards for completion utilizing less than the availed time frame for the sketching of the assembled component upon the sketch pad 26. Various grading assists such as handicapping, wherein it is awarded wherein accommodation is accessed for individuals possessing greater artistic skills than others may be employed, wherein an individual having greater artistic skill as a visual interpreter is graded lower for example than an individual possessing limited skills and such individual having limited artistic skills is awarded a greater score in the handicapping procedure. Various manners for achieving such handicap may be provided to be arbitrarily agreed upon by the individual players.

Play of the game may also be expanded to include various household objects and other objects in addition to the geometric members 14 to be positioned within the enclosure cavity 29. The categories of accuracy, detail, creativity, and time remaining are to be arbitrarily decided upon by the individual players.

It should be understood that while a multiplicity of players may take sequential turns in functioning as a judge, tactile interpreter, visual interpreter, and timer, teams of players may effect play against one another, with each team selecting various individuals to perform the various functions of judge, tactile interpreter, visual interpreter, and timer.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing an object contact interpretation game comprising the steps of, A. Providing at least three players to include a tactile interpreter, a visual interpreter, and a judge, and B. Including a plurality of geometric members, and C. Providing a writing instrument, and a sketch web, and D. Having the judge construct a geometric configuration from the geometric members, and E. Providing a bag member, and F. Having the judge position the geometric configuration within the bag member and directing the tactile interpreter to position both hands of the tactile interpreter within the bag member, and G. Describing the thusly contacted geometric configuration, and H. Directing the visual interpreter to employ the writing instrument and draw a sketch upon the sketch web from a description presented by the tactile interpreter of the geometric configuration.

2. A method as set forth in claim 1 wherein the judge upon viewing a completed sketch on the sketch web awards a point total to the visual interpreter.

3. A method as set forth in claim 2 wherein a further player is employed as a timer, and providing a timer mechanism, wherein the timer employs the timer mechanism, and a first time period is provided the tactile interpreter to contact the geometric configuration, and a further time period is awarded for the tactile interpreter to describe the geometric configuration to the visual interpreter, and a yet further time period is provided, with the visual interpreter to complete the drawing upon the sketch web.

4. A method as set forth in claim 3 wherein the step of providing the bag member includes providing the bag member with a first bag opening a second bag opening, and the first bag opening having a surrounding elastomeric web, and the second bag opening having a second elastomeric web for securing the tactile interpreter hands within the bag member during contact with the geometric configuration.

* * * * *